US012188189B2

(12) United States Patent
Bjorklund et al.

(10) Patent No.: US 12,188,189 B2
(45) Date of Patent: Jan. 7, 2025

(54) PAVEMENT MARKING SYSTEM WITH PAVEMENT MARKER DISPENSER HAVING CURVILINEAR FEED TUBE FOR IMPROVED MARKER SPACING

(71) Applicant: Crown USA, Inc., Woodbury, GA (US)

(72) Inventors: Mark S. Bjorklund, Midland, GA (US); Reise Stenberg, Argusville, ND (US)

(73) Assignee: CROWN USA, INC., Woodbury, GA (US)

( * ) Notice: Subject to any disclaimer, the term of this patent is extended or adjusted under 35 U.S.C. 154(b) by 150 days.

(21) Appl. No.: 18/108,958

(22) Filed: Feb. 13, 2023

(65) Prior Publication Data

US 2024/0271374 A1 Aug. 15, 2024

(51) Int. Cl.

| | |
|---|---|
| ***E01C 23/18*** | (2006.01) |
| ***B65D 83/04*** | (2006.01) |
| ***E01C 23/16*** | (2006.01) |
| ***E01C 23/22*** | (2006.01) |
| ***E01F 9/512*** | (2016.01) |
| ***E01F 9/518*** | (2016.01) |
| ***E01F 9/524*** | (2016.01) |

(52) U.S. Cl.

CPC ..... *E01C 23/18* (2013.01); *B65D 83/0418* (2013.01); *E01C 23/166* (2013.01); *E01C 23/22* (2013.01); *E01F 9/512* (2016.02); *E01F 9/518* (2016.02); *E01F 9/524* (2016.02)

(58) Field of Classification Search

CPC ..... E01C 23/18; E01F 9/512; B65D 83/0418

See application file for complete search history.

(56) References Cited

U.S. PATENT DOCUMENTS

| | | | | |
|---|---|---|---|---|
| 5,890,622 | A * | 4/1999 | Farmont | G07F 17/145 194/902 |
| 8,123,430 | B2 | 2/2012 | Bjorklund | |
| 8,425,144 | B2 | 4/2013 | Bjorklund | |
| 8,465,223 | B2 | 6/2013 | Bjorklund | |
| 2017/0043939 | A1* | 2/2017 | Marqua | A61J 1/03 |

FOREIGN PATENT DOCUMENTS

| | | | |
|---|---|---|---|
| FR | 2473907 | A3 * | 7/1981 |

* cited by examiner

*Primary Examiner* — Barbara J Musser

(74) *Attorney, Agent, or Firm* — Thomas | Horstemeyer, LLP

(57) ABSTRACT

A pavement marker dispenser for a pavement marking system dispenses retroreflective markers for a roadway with more accurate marker spacing. The dispenser includes an elongated feed tube that houses a generally vertical curvilinear stack of pavement markers. The feed tube has top and bottom openings to respectively receive and dispense the markers in a downwardly vertical direction. The feed tube has a nonlinear curvature along its length to produce the curvilinear stack of markers so that a downwardly vertical stacking force imposed on a bottommost marker to be dispensed is reduced. The feed tube has first and second curved portions so that the nonlinear curvature is generally serpentine in shape. A disc actuator having a pushing arm extends perpendicular to the feed tube to push the bottommost marker in a rearward and downward direction into the delivery chute, which dispenses the markers.

18 Claims, 5 Drawing Sheets

Firing

Late

PAVEMENT MARKING SYSTEM WITH PAVEMENT MARKER DISPENSER HAVING CURVILINEAR FEED TUBE FOR IMPROVED MARKER SPACING

FIELD OF THE INVENTION

The present invention generally related to a pavement marking system for applying retroreflective markers to a roadway, and more particularly, to a pavement marker dispenser for more accurately spacing the markers when applied to the pavement of the roadway.

BACKGROUND OF THE INVENTION

Over at least a ten-year period, a pavement marking system was developed and improved by one of the inventors of the present application. The pavement marking system is described in detail in the following U.S. Pat. Nos. 8,123,430; 8,425,144; and 8,465,223, all of which are incorporated herein by reference. The pavement marking system is shown in FIG. 1. The system uses a dispenser that pushes a pavement marker, or disc, out from under a stack in a forward direction, where it lands on a ramp and changes direction to rearward and downward into a molten pavement marking material, where it bonds, thereby providing a raised bump that provides an audible and vibratory alert to a driver who may be departing the driver's lane.

More specifically, with reference to FIG. 1, shown is a side elevational schematic view of the pavement marking system of the prior art as well as the method of forming a molten base line 906 and dispensing pavement markers 100. The base line 906 may be any commercially available, preferably thermoplastic, roadway marking material. Carrier 1000 comprises a commercially available single vehicle, for example but not limited to, a truck, which is advanced along the roadway surface 903 in the direction as indicated by arrow 1003.

A liquid applicator 1006 having a spray or extrusion head 1009 is mounted to the carrier 1000. As the carrier 1000 advances, the liquid applicator 1006 applies thermoplastic paint 1012 to the roadway surface 903 through the spray head 1009. The thermoplastic paint 1012 comprises thermoplastic pavement marking material that has been heated to a molten state at between 400 degrees and 425 degrees on the Fahrenheit scale. After application, thermoplastic paint 1012 forms the base line 906 for the roadway striping.

Also mounted to the carrier 1000 is a pavement marker dispenser 1015. In this embodiment, the pavement marker dispenser 1015 comprises an upwardly extending feed tube 1018, a disc actuator 1021, and a delivery chute 1024. The feed tube 1018 holds an vertical upwardly extending stack of the pavement markers 100, the stack being supported by a supporting surface 1027. The disc actuator 1021 is configured to deliver pavement markers 100 to the delivery chute 1024 at predetermined time intervals based on the speed of the carrier 1000. Thus, the disc actuator 1021 may be controlled by a commercially available skip timer.

In the embodiment of FIG. 1, the disc actuator 1021 includes a pushing mechanism 1030 for directing the lowermost pavement marker 100 in the feed tube 1018 laterally along the supporting surface 1027 in the direction of movement of the carrier 1000 to the delivery chute 1024. Upon release of a pavement marker 100, the stack in the feed tube 1018 advances downward in the direction of arrow 1031.

The pavement markers 100 are loaded in the upwardly extending feed tube 1018 with their effectively flat base surfaces facing down toward engagement with the upwardly facing opposed surfaces of the pavement markers next below. By the operation of the pushing mechanism 1030, the pavement markers 100 are given a forward velocity in the direction of arrow 1032 and are received by the delivery chute 1024. The pavement marker dispenser 1015 is designed to keep the pavement marker 100 positioned with its effectively flat base surface 103 in contact with the parts of the pavement marker dispenser 1015, and, in particular, delivery chute 1024. Such positioning tends to avoid abrasive wear that might be caused by the light reflective beads 112 engaging the delivery chute, thereby prolonging the life expectancy of the pavement marker dispenser 1015.

In some embodiments, the delivery chute 1024 may be equipped with a damper 1033 to dampen the impact of the pavement marker 100 at the surface of the delivery chute 1024 and to reduce bouncing of the pavement marker 100 when applied at a high rate of speed. Bouncing of the pavement marker 100 may lead to imprecise placement into the molten base line 906. The damper 1033 may comprise, for example, rubber bushings or a surface affixed to the delivery chute 1024 by a flexible material, such as silicone or foam.

When the pavement marker 100 engages the delivery chute 1024 or damper 1033, the gravitational force pulls the pavement marker 100 downward as shown by arrow 1036. While sliding down the delivery chute 1024 in the direction of arrow 1039, the pavement marker 100 gains a horizontal component of velocity in the direction rearward of the movement of the carrier 1000. Accordingly, when released by the delivery chute 1024 for embedding into the base line 906, the pavement marker 100 has a forwardly directed component of velocity less than that of the carrier 1000.

The pavement marker dispenser 1015 and the delivery chute 1024 are positioned on the carrier 1000 and configured so that the pavement marker 100 is released to the molten base line 906 as close to the spray head 1009 as possible, preferably within 10 inches of the spray head 1009. This positioning is desired because the thermoplastic paint 1012 cools very rapidly and the molten base line 906 needs a sufficiently high temperature to produce a bond between the pavement marker 100 and the molten base line 906. Preferably, the temperature of the molten base line 906 will be sufficiently high to partially melt the material of the pavement marker 100 so that the partially melted pavement marker 100 will fuse with the molten base line 906.

A reflective bead applicator 1042 having a dispensing head 1045 may be mounted to the carrier 1000. The reflective bead applicator 1042 releases light reflective beads 1048 through the dispensing head 1045 onto the molten base line 906. The light reflective beads 1048 may be the same as or different from the light reflective beads 112 used in the manufacture of the pavement markers 100. The light reflective beads 1048 thereby become embedded into the molten base line 906 with embedded pavement markers 100, producing a reflective base line 1051.

In an attempt to improve the wet night retro-reflectivity of the marker, a new decagonal-shaped marker was developed and patented under U.S. Pat. No. D 737,165, which is incorporated here by reference. This marker is illustrated in FIG. 2. This marker, while much more reflective than the previous design, had more issues with consistent spacing due to different lengths of time that it takes to exit the dispenser. For this reason, a new dispenser was needed to improve the variation of spacing between the markers.

SUMMARY OF INVENTION

Disclosed are various embodiments of a pavement marker dispenser for a pavement marking system that dispenses retroreflective markers for a roadway with more accurate spacing than prior art embodiments.

One embodiment, among others, is a pavement marker dispenser that includes an elongated curvilinear feed tube that houses a generally vertical curvilinear stack of pavement markers. The feed tube has top and bottom openings to respectively receive and dispense the markers in a downwardly vertical direction. The feed tube has a nonlinear curvature along its length to produce the curvilinear stack of markers so that a downwardly vertical stacking force imposed on a bottommost marker to be dispensed is reduced. The feed tube has first and second curved portions so that the nonlinear curvature is generally serpentine in shape. A disc actuator having a pushing arm extends perpendicular to the feed tube to push the bottommost marker in a rearward and downward direction towards the delivery chute, which dispenses the markers in a rearward and downward direction.

Another embodiment, among others, is a pavement marking system for applying retroreflective markers to a surface of a roadway. The system comprises (a) a liquid applicator having a spray or extrusion head, the liquid applicator capable of applying thermoplastic paint to the roadway surface through the spray or extrusion head; (b) a pavement marker dispenser; and (c) a mobile carrier that transports the pavement marker dispenser and the liquid applicator along the roadway.

The dispenser in this embodiment includes an elongated feed tube that houses a generally vertical curvilinear stack of pavement markers. The feed tube has top and bottom openings that respectively receive and dispense the markers in a downwardly vertical direction. The feed tube has a nonlinear curvature to produce the curvilinear stack of markers so that a downwardly vertical stacking force imposed on a bottommost marker to be dispensed is reduced.

The dispenser further includes a disc actuator having a pushing arm that extends perpendicular to the feed tube to push the bottommost marker in a generally rearward and downward direction and that unextends to advance the stack of markers downwardly in the vertical direction so that a next marker that was situated adjacent to the bottommost marker is in a position to be dispensed next.

Finally, the dispenser includes a delivery chute that receives the markers from the pushing arm and deposits the markers onto the thermoplastic paint in a molten state on the roadway surface.

Yet another embodiment, among others, is a method that employs the system of the previously described embodiment to form roadway markings on a paved roadway. The roadway markings include a base line and reflective pavement markers applied at intervals to the base line with the pavement markers having an effectively flat base surface and an opposed surface. The method can be summarized by the following steps:

(a) advancing the mobile carrier along the roadway at a predetermined speed in a forward direction;

(b) as the mobile carrier is advanced: (1) applying liquid from the liquid applicator mounted on the carrier to the roadway to form the base line on the roadway, (2) moving the bottommost marker from the bottom of the stack out from beneath the stack of the pavement markers with the base surface of the bottommost pavement marker facing downwardly and forwardly, (3) after the bottommost pavement marker has been moved out from beneath the stack, sliding the tilted pavement marker downwardly along the delivery chute and directed rearwardly of the forward direction while the base surface of the pavement marker is in its tilted attitude and facing the forward direction;

(c) applying the bottommost pavement marker to the base line; and (d) tilting the bottommost pavement marker as the bottommost pavement marker is applied to the base line so that its base surface is horizontal.

Other embodiments, systems, apparatus, methods, features, and advantages of the present invention will be or become apparent to one with skill in the art upon examination of the following drawings and detailed description. It is intended that all such additional embodiments, systems, apparatus, methods, features, and advantages be included within this description, be within the scope of the present invention, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENT(S)

A. Experimentation And Testing

In order to determine the effectiveness of the new pavement marker dispenser 1050 (FIGS. 3-5), extensive experimentation and testing was performed by the inventor. More specifically, a proximity sensor was installed on the existing dispenser 1015 (FIG. 1) to determine the variation of time from when the electrical signal was given to operate the dispenser 1015 versus the time it took for the marker 100 to exit the dispenser 1015. This variation in time directly correlates to the difference in distance between the markers 100 as the markers 100 are applied to the molten pavement. A summary of the experimental test data is given below in Chart A.

CHART A

| Existing dispenser time variation converted to distance at common road striping speeds: | | |
|---|---|---|
| Inches off at 3.5 mph: | Minimum: 0.002878 inches | Maximum: 7.091532 inches |
| Inches off at 5.0 mph: | Minimum: 0.004112 inches | Maximum: 10.13076 inches |

As the data reflects in Table A, the consistency of the time it takes each marker 100 to exit the dispenser 1015 needed improvement. Video taken of the markers 100 leaving the dispenser 1015 showed that some markers 100 would juggle for a short period of time, while others did not in the transition from moving forward before dropping on the slide, or chute, 1024. Others might bounce on the slide itself, slowing the rearward exit of the marker from the dispenser 1015. To prevent this, the forward motion step was eliminated, and the marker 100 was pushed directly rearward and downward in the direction of the slide 1024. The speed at which the marker 100 is dispensed can be controlled via a flow control valve on the incoming air supply. Performance was modestly better. A second air cylinder was added to increase the force available to be applied, and modest improvement was found again.

After testing under various conditions, the inventor determined that the dispenser consistency improved when the stack of markers 100 was fewer, and there was less weight on the marker 100 at the bottom of the stack that was being dispensed. Unfortunately, a stack of up to two hundred markers 100 is often required to provide a safe distance away from the roadway for an operator to load new markers 100 into the feed tube to replace those that have been dispensed onto the roadway. A stack of one hundred markers 100 was weighed with the feed tube supported, and the bottommost marker 100 exhibited 9.5 lbs. of force on a weight scale.

Figure 3:
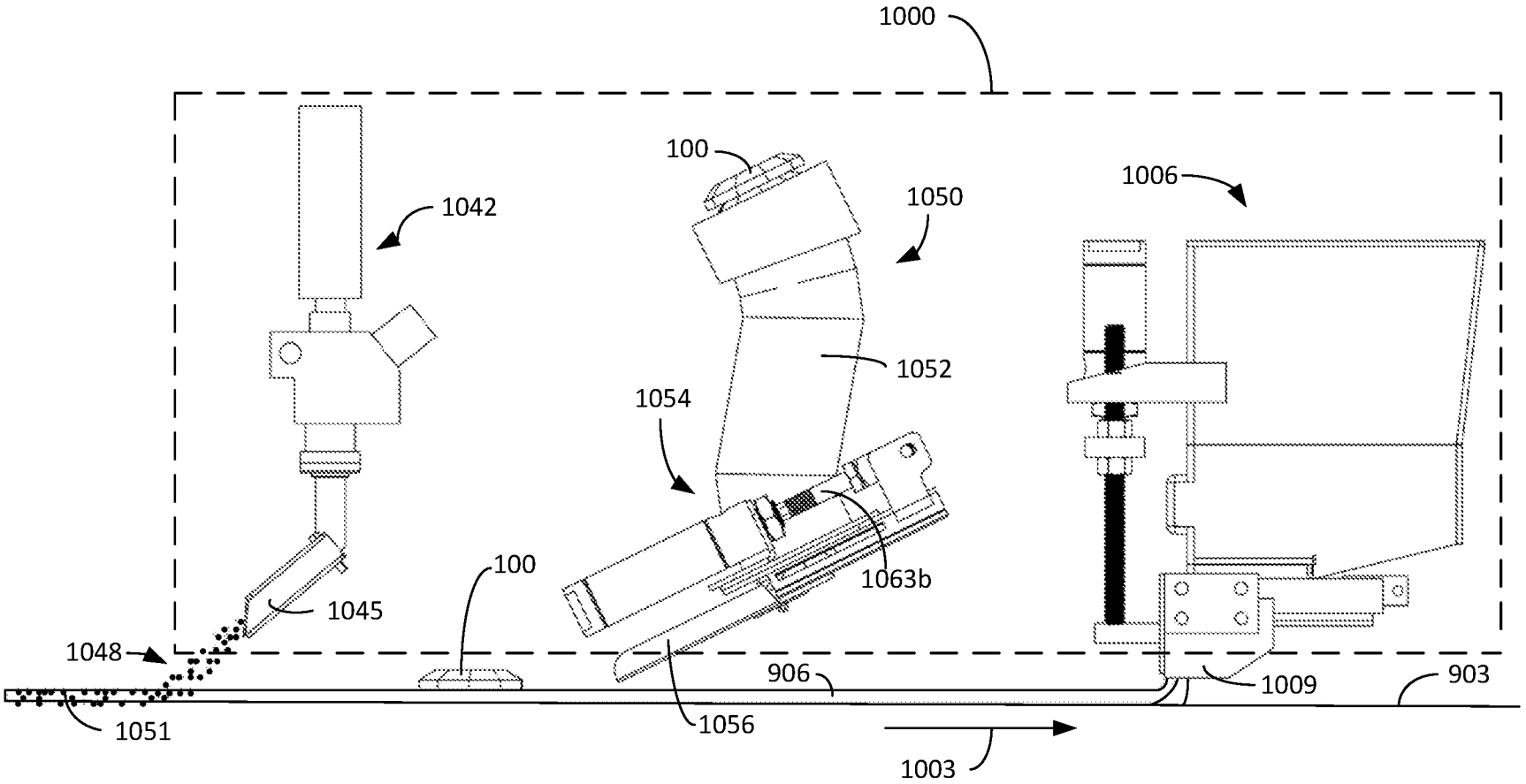
FIG. 3 is a side elevational schematic view of a pavement marking system with the new pavement marker dispenser of the present disclosure that was recently developed by the inventors.

Two slight bends were placed in the feed tube that houses the stack of markers 100 to create a curvilinear stack. The curvilinear stack of markers 100 offset the weight of the stack on the feed tube itself, rather than on the bottommost marker 100 being dispensed. The first attempt at this concept by the inventor created several misfeeds, but the angles were reduced, and the distance between the angles was increased until acceptable feeding was obtained, resulting in the final design for the new pavement marker dispenser 1050 (FIGS. 3-5). The weight of the stack of markers 100 was compared to the previous version and only exhibited 2.1 lbs. of force. This configuration significantly improved the consistency of the time the marker 100 took to leave the new pavement marker dispenser 1050, and the following summarized data of Chart B was obtained.

CHART B

| New pavement marker dispenser 1050 (the present invention): | | |
|---|---|---|
| Inches off at 3.5 mph: | Minimum: 0.015586 inches | Maximum: 1.98679 inches |
| Inches off at 5.0 mph: | Minimum: 0.022265 inches | Maximum: 2.83827 inches |

As is demonstrated by the above data, the new pavement marker dispenser 1050 of the present disclosure is capable of dispensing markers five times more accurately than the any previous version. Furthermore, a road test was conducted and all markers 100 that were measured were within one inch of the desired spacing of 30 inches between markers 100.

B. Pavement Marking System with New Pavement Marker Dispenser

Figure 2A:
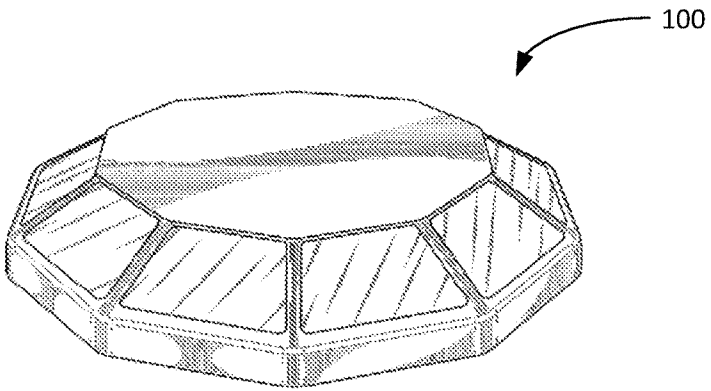
PRIOR ART FIG. 2A
FIG. 2A is a perspective view of a pavement marker of the prior art that was used in the pavement marking system of FIG. 1 and that is used in the pavement marking system of FIG. 3.
Figure 2B:
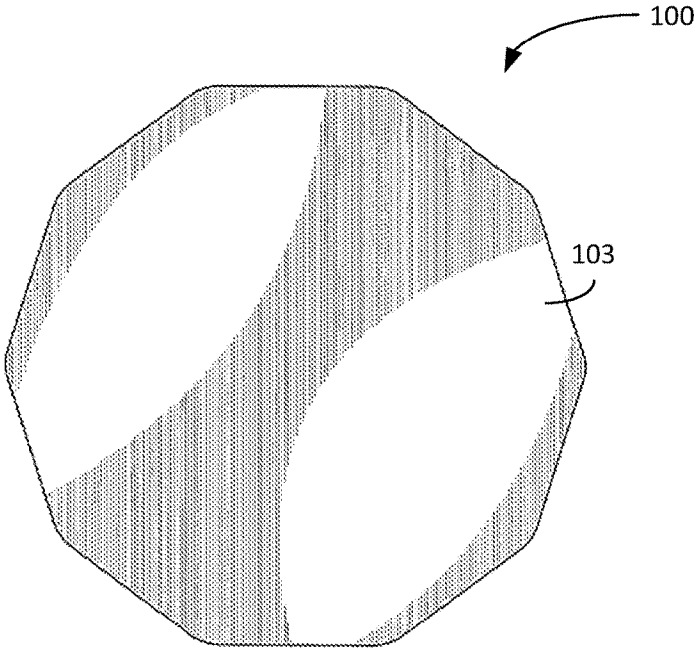
PRIOR ART FIG. 2B
FIG. 2B is a bottom view of the pavement marker of FIG. 2A.

The architecture and operation of a preferred embodiment of the pavement marking system 1000 of the present disclosure will now be discussed. FIG. 3 is a side elevational schematic view of the pavement marking system 1000 with a new pavement marker dispenser 1050. The pavement marker dispenser 1050 is specifically designed for use with the pavement marker 100 (FIGS. 2A and 2B). However, the pavement marker dispenser 1050 will also work well with a variety of other marker designs, for example but not limited to, the marker 100 shown and described in one of the inventor's U.S. Pat. No. 8,123,430. The new pavement marker dispenser 1050 makes more consistent the length of time needed for each marker 100 to exit the dispenser 1050, thereby significantly improving the variation of spacing between the pavement markers 100.

Figure 1:
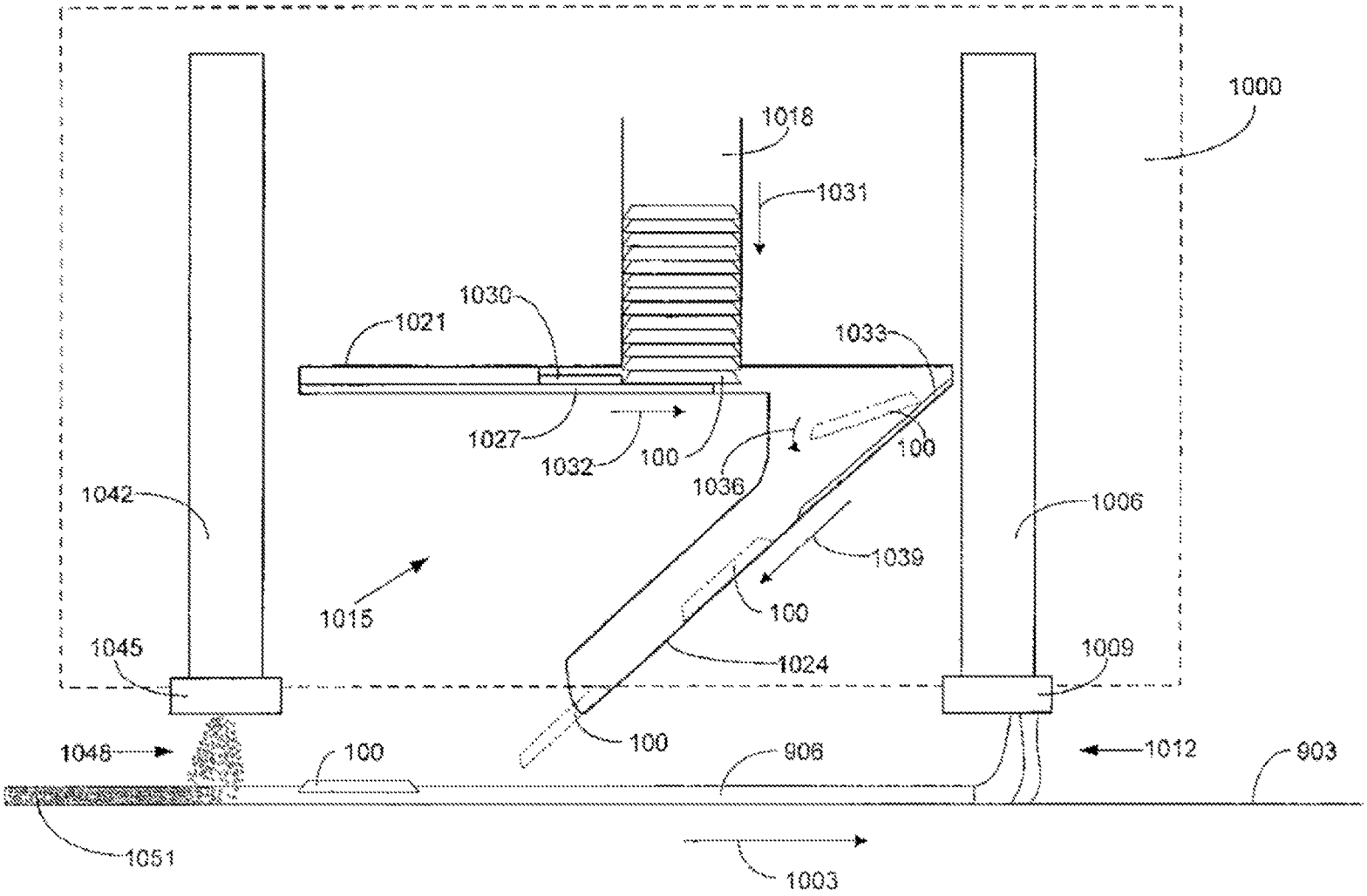
PRIOR ART FIG. 1
FIG. 1 is a side elevational schematic view of a pavement marking system of the prior art that was developed by the inventor of the present application.

Referring now to FIG. 1, shown is a side elevational schematic view of the pavement marking system 1000 with the marker dispenser 1050 as well as a method of forming a molten base line 906 and dispensing pavement markers 100. The base line 906 may be any commercially available, preferably thermoplastic, roadway marking material. Mobile carrier 1000 comprises any suitable commercially available motor vehicle, for example but not limited to, a Model 4-4000-DP truck manufactured by Mark Rite Lines in Billings, Montana, which is advanced along the roadway surface 903 in the direction as indicated by arrow 1003.

A liquid applicator 1006 having a spray or extrusion head 1009 is mounted to the carrier 1000. As the carrier 1000 advances, the liquid applicator 1006 applies thermoplastic paint 1012 to the roadway surface 903 through the spray or extrusion head 1009. The thermoplastic paint 1012 comprises thermoplastic pavement marking material that has been heated to a molten state at between 400 degrees and 425 degrees Fahrenheit. It is understood that different paint materials may require different application temperatures. Furthermore, although the term "paint" is used, "paint" is understood herein to refer to any type of pavement marking material. After application, thermoplastic paint 1012 forms the base line 906 for the roadway striping.

Figure 4A:
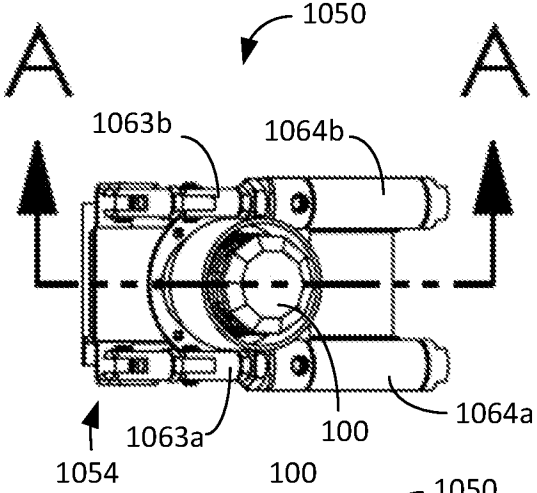
FIG. 4A is a top view of the pavement marker dispenser of FIG. 3.
Figure 4B:
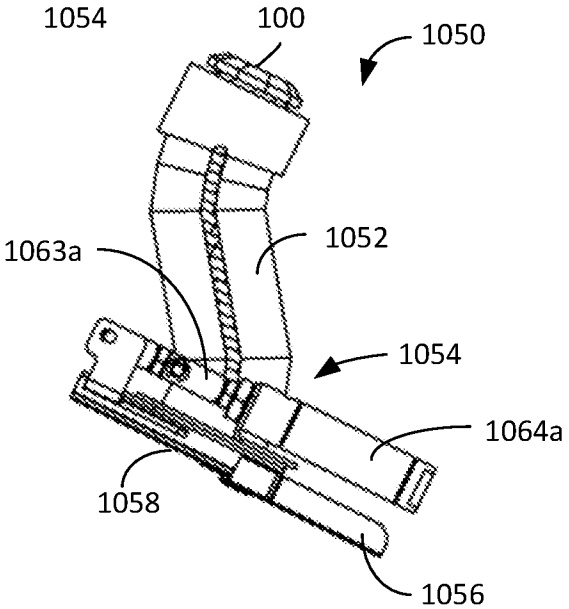
FIG. 4B is left side view of the pavement marker dispenser of FIG. 3.
Figure 4C:
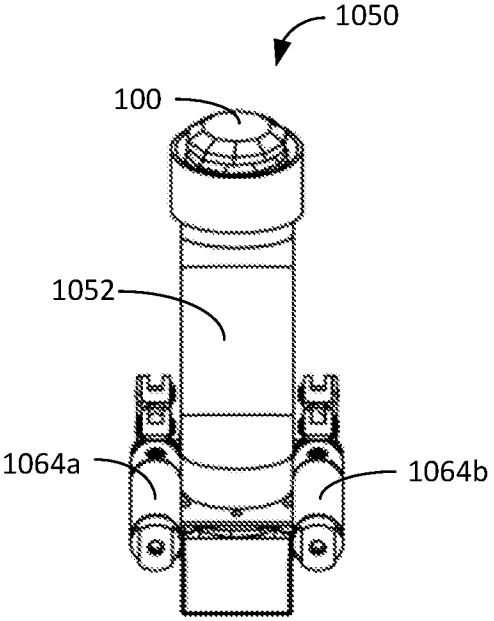
FIG. 4C is a front side view of the pavement marker dispenser of FIG. 3.

Also mounted to the mobile carrier 1000 is a pavement marker dispenser 1050. In this embodiment, as illustrated in FIGS. 4A, 4B, and 4C, the pavement marker dispenser 1015 comprises an upwardly extending feed tube 1052, a disc actuator 1054, and a delivery chute 1056. The feed tube 1052 holds a vertical upwardly extending stack of the pavement markers 100, the stack being supported by a supporting surface 1058. The disc actuator 1054 is configured to deliver pavement markers 100 to the delivery chute 1056 at predetermined time intervals based on the speed of the carrier 1000. Thus, the disc actuator 1054 may be controlled by a commercially available skip timer, controller, or other suitable control device (not shown). An example of a commercially available skip timer that can be used is a Model STS-2000 skip timing system manufactured by EPIC Solutions in Fargo, North Dakota, U.S.A.

Figure 5B:
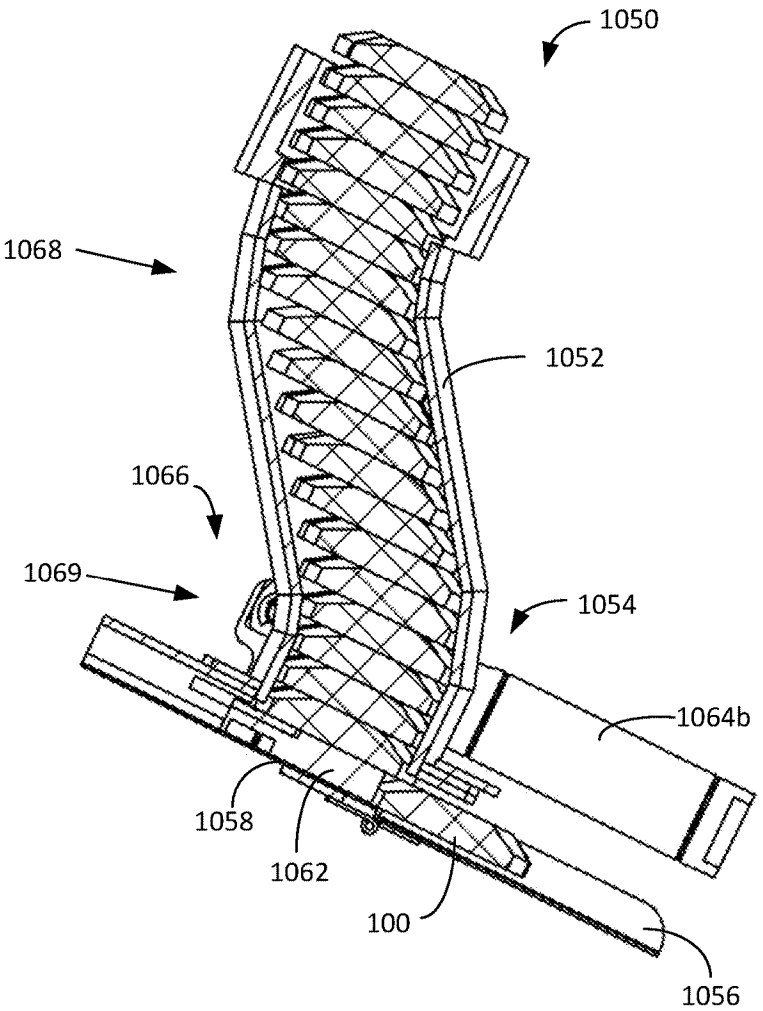
FIG. 5B is a cross-sectional view of the pavement marker dispenser of FIG. 3 in a firing position (causing marker to dispense) taken along line A-A of FIG. 4A.
Figure 5A:
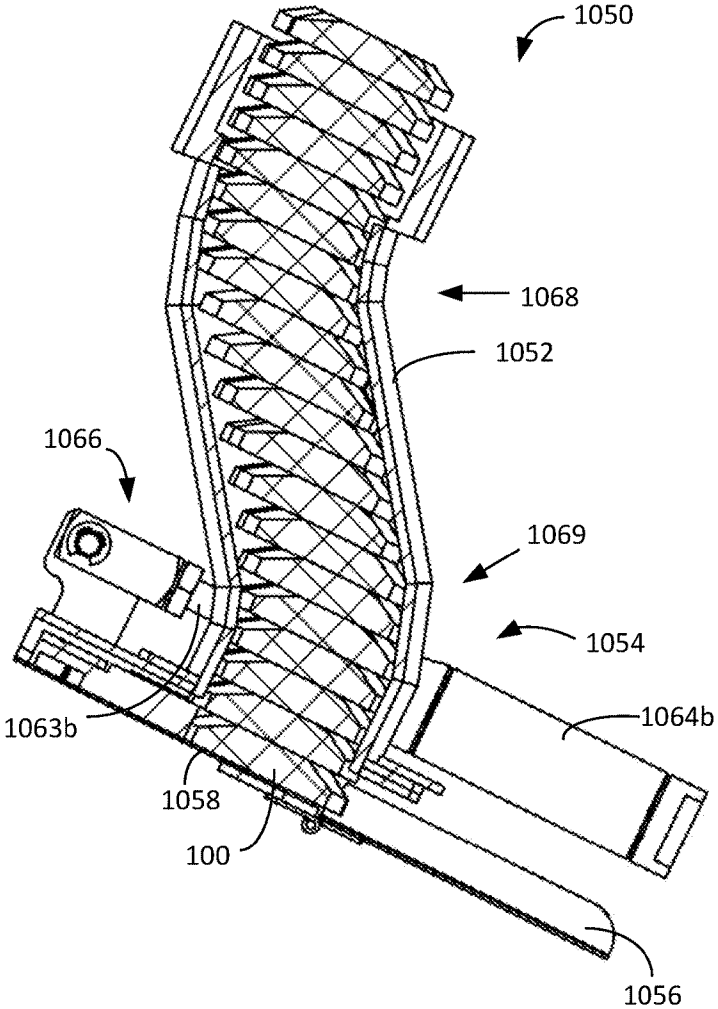
FIG. 5A is a cross-sectional view of the pavement marker dispenser of FIG. 3 in an idle position taken along line A-A of FIG. 4A in accordance with a preferred embodiment of the present disclosure.

In the preferred embodiment of FIG. 3, the disc actuator 1054 includes a linear pushing arm (or slide) 1062, shown in FIGS. 5A and 5B, for directing the lowermost (or bottommost) pavement marker 100 in the feed tube 1018 laterally along the supporting surface 1058 in the direction of movement of the carrier 1000 to the delivery chute 1056. The pushing arm 1062 extends perpendicular to the feed tube 1052 from an idle position to push the bottommost marker in a generally rearward and downward direction onto the delivery chute 1056 and, afterward, unextends to advance the stack of markers 100 downwardly in the vertical direction so that a next marker 100 upwardly adjacent to the bottommost marker 100 is in a position to be dispensed next. The vertical height of the pushing arm 1062 is slightly smaller than the vertical height of the marker 100 to ensure that the bottommost marker 100 can be pushed without pushing the next marker 100.

The pushing arm 1062 is mechanically connected to and movable by one or more piston rods 1063 that extend and unextend from one or more cylinder barrels associated with one or more pneumatic and/or hydraulic cylinders, respectively. Each piston rod 1063 moves linearly in and out of a respective cylinder barrel associated with the respective pneumatic and/or hydraulic cylinder.

In the preferred embodiment, the pushing arm 1062 is mechanically connected to the two generally parallel piston rods 1063*a*, 1063*b* associated with two parallel pneumatic air cylinders 1064*a*, 1064*b*, respectively, via suitable mechanical linkage 1066 so that the pushing arm 1062 is moved between the firing position and the idle position, as illustrated in FIGS. 5A and 5B. Each cylinder 1064 is controlled by controlling the air to each with a respective solenoid-controlled, flow control valve on the incoming air supply. The valves are in turn controlled electronically via a commercially available skip timer, controller, or other suitable control device.

In an alternative embodiment, the disc actuator 1054 may be an air-actuated sliding shoe. In other embodiments, the disc actuator 1021 may implemented by, for example but not limited to, a rotating helical surface configured to support the stack of pavement markers 100 in the feed tube 1052 and to rotate to allow a pavement marker 100 to drop down and be received by the delivery chute 1056.

The elongated feed tube 1052 is designed to house the pavement markers 100 in a generally vertical curvilinear stack. The feed tube has top and bottom openings that respectively receive and dispense the markers 100 in a downwardly vertical direction. The feed tube 1052 has a nonlinear curvature to produce the curvilinear stack of markers 100 so that a downwardly vertical stacking force imposed on the lowermost (or bottommost) marker 100 to be dispensed is reduced. In the preferred embodiment, as best shown in FIGS. 5A and 5B, the feed tube 1052 has first and second curved portions 1068, 1069 so that the nonlinear curvature is generally serpentine shaped.

When each pavement marker 100 engages the delivery chute 1056, the pavement marker 100 has a horizontal component of velocity in the direction rearward of the movement of the carrier 1000. Accordingly, when released by the delivery chute 1056 for embedding into the base line 906, the pavement marker 100 has a forwardly directed component of velocity less than that of the carrier 1000. Preferably, the pavement marker 100 will have a forwardly directed component of velocity less than 1 mph when the pavement marker 100 contacts the molten base line 906. By having a net forward ground speed less than that of the mobile carrier 1000, surfing and skidding of the pavement marker 100 on the base line 906 are reduced.

When the pavement marker 100 is released from the delivery chute 1056, the base surface 103 is sloped facing downwardly and forwardly of the pavement marker dispenser 1050. A slight tilt of between 20 and 35 degrees helps to prevent a number of defects from occurring.

The angle of the delivery chute 1056 may be selected based on the desired speed of the mobile carrier 1000. For example, the mobile carrier 1000 may be moving at a speed of between 2 and 7 mph. It has been observed that roadway striping crews prefer to apply pavement markings at a speed of between 3 and 5 mph. Therefore, the length and angle of the delivery chute 1056, and the corresponding rearward velocity may be fixed for the common case, as depicted in FIG. 3. In another embodiment, the angle of the delivery chute 1024 may be adjustable. In yet another embodiment, the delivery chute 1056 may exhibit a varied angle of descent by having a first slope followed by a second slope, the first slope having a steeper angle of descent than the second slope.

The pavement marker dispenser 1056 and the delivery chute 1056 are positioned on the carrier 1000 and configured so that the pavement marker 100 is released to the molten base line 906 as close to the spray or extrusion head 1009 as possible, preferably within ten inches of the spray head 1009. This positioning is desired because the thermoplastic paint 1012 cools very rapidly, and the molten base line 906 needs a sufficiently high temperature to produce a bond between the pavement marker 100 and the molten base line 906. Preferably, the temperature of the molten base line 906 will be sufficiently high to partially melt the material of the pavement marker 100 so that the partially melted pavement marker 100 will fuse with the molten base line 906.

Optionally, but preferably, a reflective bead applicator 1042 having a dispensing head 1045 may be mounted to the carrier 1000. The reflective bead applicator 1042 releases light reflective beads 1048 through the dispensing head 1045 onto the molten base line 906. The light reflective beads 1048 may be the same as or different from the light reflective beads 112 used in the manufacture of the pavement markers 100. The light reflective beads 1048 thereby become embedded into the molten base line 906 with embedded pavement markers 100, producing a reflective base line 1051.

C. Variations and Modifications

It should be emphasized that the above-described embodiments of the present invention, particularly, any "preferred" embodiments, are merely possible nonlimiting examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

The invention claimed is:

1. A pavement marking system for applying retroreflective markers with improved marker spacing to a surface of a roadway, the system comprising:

(a) a liquid applicator having a spray or extrusion head, the liquid applicator capable of applying thermoplastic paint to the roadway surface through the spray head;

(b) a pavement marker dispenser, the dispenser having:

(1) an elongated feed tube that houses a generally vertical curvilinear stack of pavement markers, the feed tube having top and bottom openings that respectively receive and dispense the markers in a downwardly vertical direction, the feed tube having a nonlinear curvature to produce the curvilinear stack of markers so that a downwardly vertical stacking force imposed on a bottommost marker to be dispensed is reduced;

(2) a disc actuator, the disc actuator having a pushing arm that extends perpendicular to the feed tube to push the bottommost marker in a rearward and downward direction and that unextends to advance the stack of markers downwardly in the vertical direction so that a next marker that was situated adjacent to the bottommost marker is in a position to be dispensed next; and (3) a delivery chute that receives the markers from the pushing arm and deposits the markers onto the thermoplastic paint in a molten state on the roadway surface; and (c) a mobile carrier that transports the pavement marker dispenser and the liquid applicator along the roadway.

2. The system of claim 1, wherein the feed tube has first and second curved portions so that the nonlinear curvature is serpentine shaped.

3. The system of claim 1, wherein the disc actuator comprises:

a cylinder or a plurality of cylinders, each having a piston rod that moves linearly in and out of a respective cylinder barrel, each of the piston rods being connected via mechanical linkage to the pushing arm, each piston rod controlled to periodically extend and unextend the pushing arm.

4. The system of claim 3, wherein the cylinders are pneumatic air cylinders.

5. The system of claim 1, further comprising a reflective bead applicator transported by the mobile carrier, the reflective bead applicator having a dispensing head, the reflective bead applicator releasing light reflective beads through the dispensing head onto thermoplastic paint.

6. A method that employs the system of claim 1 to form roadway markings on a paved roadway, the roadway markings including a base line and reflective pavement markers applied at intervals to the base line with the pavement markers having an effectively flat base surface and an opposed surface, the method comprising the steps of:

advancing the mobile carrier along the roadway at a predetermined speed in a forward direction;

as the mobile carrier is advanced: applying liquid from the liquid applicator mounted on the carrier to the roadway to form the base line on the roadway, moving the bottommost marker from the bottom of the stack in the rearward and downward direction out from beneath the stack of the pavement markers with the base surface of the bottommost pavement marker facing downwardly and forwardly, after the bottommost pavement marker has been moved in the rearward and downward direction out from beneath the stack, sliding the tilted pavement marker downwardly along a sloped surface directed rearwardly of the forward direction while the base surface of the pavement marker is in its tilted attitude and facing the forward direction, applying the bottommost pavement marker to the base line, and tilting the bottommost pavement marker as the bottommost pavement marker is applied to the base line so that its base surface is horizontal.

7. A method that employs the system of claim 1 to apply roadway markings on a paved roadway, the roadway markings including a base line and the pavement markers having a base surface and an opposed surface with the base surface applied to the base line, the method comprising the steps of:

advancing the liquid applicator along the roadway in a forward direction, and as the liquid applicator advances along the roadway applying a heated liquid from the liquid applicator to the roadway at a temperature sufficient to form a molten base line along the roadway;

advancing the stack of pavement markers in the forward direction along the roadway behind said liquid applicator;

as the liquid applicator and the stack of pavement markers advance forwardly along the roadway, moving the bottommost pavement marker out from beneath the bottom of the stack of the pavement markers to the delivery chute;

after the bottommost pavement marker has moved out from beneath the stack of the pavement markers and the stack of pavement markers no longer engages the moved bottommost pavement marker, sliding the moved bottommost pavement marker along the sloped surface directed downwardly and rearwardly toward the molten base line;

dropping the pavement marker directly into the molten base line; and connecting the bottommost pavement marker to the molten base line as the base line cools.

8. A pavement marker dispenser for dispensing retroreflective markers for a roadway, the dispenser comprising:

an elongated feed tube that has a sufficient length and diameter to house a generally vertical curvilinear stack of pavement markers, the feed tube having top and bottom openings of a sufficient size and shape to respectively receive and dispense the markers in a downwardly vertical direction, the feed tube having a nonlinear curvature along its length to produce the curvilinear stack of markers, the feed tube having first and second curved portions so that the nonlinear curvature is generally serpentine in shape;

a disc actuator, the disc actuator having a pushing arm that extends horizontally perpendicular to the feed tube to push the bottommost marker in a generally horizontal direction into a delivery chute and that unextends to advance the stack of markers downwardly in the vertical direction so that a next marker that was situated adjacent to the bottommost marker is in a position to be dispensed next; and a delivery chute that receives the markers from the dispenser and dispenses the markers in a generally vertical direction.

9. The dispenser of claim 8, wherein the disc actuator comprises:

a cylinder or a plurality of cylinders, each having a piston rod that moves linearly in and out of a respective cylinder barrel, each of the piston rods being connected via mechanical linkage to the pushing arm, each piston rod controlled to periodically extend and unextend the pushing arm.

10. The system of claim 9, wherein the cylinders are pneumatic air cylinders.

11. The system of claim 8, further comprising a motor vehicle for transporting the marker dispenser.

12. An improvement for a pavement marking system for applying retroreflective markers to a surface of a roadway, the pavement marking system comprising:

(a) a liquid applicator having a spray head, the liquid applicator capable of applying thermoplastic paint to the roadway surface through the spray head;

(b) a pavement marker dispenser, the dispenser having:

(1) an elongated feed tube that houses a generally vertical stack of pavement markers, the feed tube having top and bottom openings that respectively receive and dispense the markers in a downwardly vertical direction;

(2) a disc actuator, the disc actuator having a pushing arm that extends perpendicular to the feed tube to push the bottommost marker in a downward and rearward direction and that unextends to advance the stack of markers downwardly in the vertical direction so that a next marker that was situated adjacent to the bottommost marker is in a position to be dispensed next; and (3) a delivery chute that receives the markers from the pushing arm and deposits the markers onto the thermoplastic paint in a molten state on the roadway surface; and (c) a motor vehicle that transports the pavement marker dispenser and the liquid applicator along the roadway;

wherein the improvement comprises a new pavement marker dispenser having an elongated curvilinear feed tube that houses a generally vertical curvilinear stack of pavement markers, the feed tube having a nonlinear curvature with two bends along its vertical length to produce the curvilinear stack of markers so that a downwardly vertical stacking force imposed on a bottommost marker to be dispensed is reduced.

13. The system of claim 12, wherein the feed tube is serpentine in shape.

14. The system of claim 12, wherein the improvement further comprises a disc actuator having a cylinder or a plurality of cylinders, each having a piston rod that moves linearly in and out of a respective cylinder barrel, each of the piston rods being connected via mechanical linkage to the pushing arm, each piston rod controlled to periodically extend and unextend the pushing arm.

15. The system of claim 14, wherein the cylinders are pneumatic air cylinders.

16. The system of claim 12, further comprising a reflective bead applicator transported by the motor vehicle, the reflective bead applicator having a dispensing head, the reflective bead applicator releasing light reflective beads through the dispensing head onto thermoplastic paint.

17. A method that employs the system of claim 12 to form roadway markings on a paved roadway, the roadway markings including a base line and reflective pavement markers applied at intervals to the base line with the pavement markers having an effectively flat base surface and an opposed surface, the method comprising the steps of:

advancing the mobile carrier along the roadway at a predetermined speed in a forward direction;

as the mobile carrier is advanced: applying liquid from the liquid applicator mounted on the carrier to the roadway to form the base line on the roadway, moving the bottommost marker from the bottom of the stack in the downward and rearward direction out from beneath the stack of the pavement markers with the base surface of the bottommost pavement marker facing downwardly an forwardly, after the bottommost pavement marker has been moved out from beneath the stack, sliding the tilted pavement marker downwardly and rearwardly along the delivery chute while the base surface of the pavement marker is in its tilted attitude and facing the forward direction, applying the bottommost pavement marker to the base line, and tilting the bottommost pavement marker as the bottommost pavement marker is applied to the base line so that its base surface is horizontal.

18. A method that employs the system of claim 12 to apply roadway markings on a paved roadway, the roadway markings including a base line and the pavement markers having a base surface and an opposed surface with the base surface applied to the base line, the method comprising the steps of:

advancing the liquid applicator along the roadway in a forward direction, and as the liquid applicator advances along the roadway applying a heated liquid from the liquid applicator to the roadway at a temperature sufficient to form a molten base line along the roadway;

advancing the stack of pavement markers in the forward direction along the roadway behind said liquid applicator;

as the liquid applicator and the stack of pavement markers advance forwardly along the roadway, moving the bottommost pavement marker out from beneath the bottom of the stack of the pavement markers to the delivery chute;

after the bottommost pavement marker has moved out from beneath the stack of the pavement markers and the stack of pavement markers no longer engages the moved bottommost pavement marker sliding the moved bottommost pavement marker along the delivery chute downwardly and rearwardly of the forward direction toward the molten base line;

dropping the pavement marker directly into the molten base line; and connecting the bottommost pavement marker to the molten base line as the base line cools or cures.

* * * * *